US007240389B2

(12) United States Patent
Kim

(10) Patent No.: US 7,240,389 B2
(45) Date of Patent: Jul. 10, 2007

(54) METHOD OF CONSTRUCTING PARTIALLY EARTH-ANCHORED CABLE-STAYED BRIDGE USING THERMAL PRESTRESSING TECHNIQUE

(75) Inventor: Sang-hyo Kim, Seoul (KR)

(73) Assignee: Industry-Academic Cooperation Foundation, Yonsei University, Seoul (KR)

( * ) Notice: Subject to any disclaimer, the term of this patent is extended or adjusted under 35 U.S.C. 154(b) by 0 days.

(21) Appl. No.: 11/372,124

(22) Filed: Mar. 10, 2006

(65) Prior Publication Data

US 2006/0200920 A1 Sep. 14, 2006

(30) Foreign Application Priority Data

Mar. 11, 2005 (KR) ..... 10-2005-0020395

(51) Int. Cl.
*E01D 21/00* (2006.01)

(52) U.S. Cl. ..... 14/74.5; 14/77.1

(58) Field of Classification Search ..... 14/74.5, 14/77.1

See application file for complete search history.

(56) References Cited

U.S. PATENT DOCUMENTS 5,743,326 A * 4/1998 Slocum ..... 165/47

6,490,745 B1 * 12/2002 Kim ..... 14/77.1

FOREIGN PATENT DOCUMENTS

JP 9-100513 * 4/1997

* cited by examiner

*Primary Examiner*—Gary S. Hartmann
(74) *Attorney, Agent, or Firm*—Stein, McEwen & Bui, LLP

(57) ABSTRACT

Disclosed is a method of constructing partially earth-anchored cable-stayed bridges using a thermal prestressing technique, in which, when a steel girder-type partially earth-anchored cable-stayed bridge is built using a cantilever construction technique, the center of an intermediate span of the bridge is closed with a final key segment using a thermal prestressing technique, thus applying an initial axial tensile force to reinforcing girders of the bridge. To apply the initial axial tensile force to the reinforcing girders while the center of the intermediate span is closed with the final key segment, an appropriate space length required for closure of the final key segment is determined, and both the heating region and the heating temperature of the reinforcing girders according to the initial axial tensile force to be applied to the reinforcing girders during a process of manufacturing the final key segment are determined. Thereafter, the reinforcing girders are heated using a heating means according to the above-determined conditions, thus being thermally lengthened to predetermined lengths corresponding to the predetermined space length. The junction between the reinforcing girders at the center of the intermediate span is closed with the final key segment and, thereafter, the heating means is removed from the reinforcing girders.

4 Claims, 3 Drawing Sheets

METHOD OF CONSTRUCTING PARTIALLY EARTH-ANCHORED CABLE-STAYED BRIDGE USING THERMAL PRESTRESSING TECHNIQUE

BACKGROUND OF THE INVENTION

1. Field of the Invention

The present invention relates, in general, to a method of constructing partially earth-anchored cable-stayed bridges using a thermal prestressing technique and, more particularly, to a method of constructing partially earth-anchored cable-stayed bridges using a thermal prestressing technique, in which, while a steel girder-type partially earth-anchored cable-stayed bridge is built using a cantilever construction technique, the center of an intermediate span of the bridge is closed with a final key segment using a thermal prestressing technique, thus applying an appropriate initial axial tensile force to reinforcing girders of the bridge.

2. Description of the Related Art

In recent years, as bridges for spans of about 200~1000 m, cable-stayed bridges have been recognized as appropriate structures having good appearances and providing high economic efficiency. However, according to the lengthening of the spans, the cable-stayed bridges are problematic in that an excessive compressive force is applied to the upper structure of the bridges, so that buckling may be caused in the towers of the bridges.

In an effort to solve the problems of the conventional cable-stayed bridges, a partially earth-anchored cable-stayed bridge, in which an initial tensile force is artificially applied to the reinforcing girders of the bridge so as to reduce the excessive compressive force from the upper structure of the bridge, has been studied and proposed. However, in the related art, there has been no appropriate construction technique of applying tensile force generated using outside anchor cables to an intermediate span of a bridge in a process of closing the center of an intermediate span of the bridge with a final key segment, so that the partially earth-anchored cable-stayed bridge has not actually been built and put to practical use anywhere in the world.

Here, the technical term "final key segment" has the following meaning. That is, in a cantilever construction process of building a cable-stayed bridge by constructing two support towers and by gradually extending reinforcing girders from the two towers, the final key segment is a final closure element to couple the reinforcing girders to each other at the center of an intermediate span between the two towers while compensating for construction error generated between the reinforcing girders separately and respectively extending from the two towers. The coupling of the two reinforcing girders using the final key segment is so-called "closure of the final key segment" in the related art, and the step of closing the junction between two reinforcing girders with a final key segment has been recognized as the most important step in the process of building a cable-stayed bridge using a cantilever construction technique.

In a conventional technique that can be adapted to a process of building a partially earth-anchored cable-stayed bridge requiring an appropriate initial tensile force to be applied to reinforcing girders, excessive compressive force is applied to the reinforcing girder of the cable-stayed bridge (a so-called "self-anchored cable-stayed bridge") due to the long span of the cable-stayed bridge, so that the bridge must be designed such that the reinforcing girders have a large sectional area in proportion to the excessive compressive force. Furthermore, at the step of closing the junction between the reinforcing girders of the intermediate span with a final key segment in the conventional technique, the facing ends of the reinforcing girders of the intermediate span must be prestressed with an appropriate tensile force using prestressing machines, such as hydraulic jacks, prior to closing the junction between the reinforcing girders with the final key segment.

In other words, in a conventional technique of closing the junction between the reinforcing girders at the center of the intermediate span with a final key segment, the reinforcing girders are prestressed using hydraulic jacks and provide an appropriate space for the closure of the final key segment. However, to close the junction between the reinforcing girders with a final key segment using the conventional technique, a plurality of prestressing anchors must be installed at the ends of the reinforcing girders and, furthermore, the ends of the huge reinforcing girders must be prestressed with a uniform tensile force using a plurality of hydraulic jacks, and this causes difficulty in the conventional technique of building a partially earth-anchored cable-stayed bridge.

In the related art, a partially earth-anchored cable-stayed bridge may be built through a process, in which, after the junction between the reinforcing girders has been completely closed with a final key segment, cables are anchored to outside anchors and, thereafter, tensile force is applied to the reinforcing girders. However, this process is problematic in that it is almost impossible to separately anchor the cables, each comprising a great number of steel wires, to the outside anchors such that a uniform tensile force can be applied to the respective steel wires of the cables.

Therefore, in the related art, it has been required to provide a new technique of applying tensile force to the reinforcing girders of a partially earth-anchored cable-stayed bridge in an effort to solve the problems experienced in the conventional technique of building the partially earth-anchored cable-stayed bridge.

SUMMARY OF THE INVENTION

Accordingly, the present invention has been made keeping in mind the above problems occurring in the related art, and an object of the present invention is to provide a method of constructing a partially earth-anchored cable-stayed bridge using a thermal prestressing technique, in which the center of an intermediate span of the bridge is closed with a final key segment using the thermal prestressing technique, thus artificially applying axial tensile force to reinforcing girders of the bridge.

Furthermore, by constructing a partially earth-anchored cable-stayed bridge using a thermal prestressing technique, the bridge constructing method according to the present invention imparts an artificial axial tensile force to the reinforcing girders of the bridge, thus improving the safety of the reinforcing girders regardless of the length of the span of the cable-stayed bridge, and reducing the excessive compressive force applied to the reinforcing girders, and reducing the compressive force around the towers, so that the sectional area of the reinforcing girders around the towers can be reduced to desired levels.

In order to achieve the above objects, according to one aspect of the present invention, there is provided a method of constructing a partially earth-anchored cable-stayed bridge using a thermal prestressing technique, in which, to apply a predetermined initial axial tensile force to reinforcing girders of the bridge, the initial axial tensile force is applied to the reinforcing girders while the center of an intermediate span of the bridge is closed with a final key segment, the method comprising: a first step of determining an appropriate space length required for closure of the final key segment and of determining both a heating region and a heating temperature of the reinforcing girders according to the initial axial tensile force to be applied to the reinforcing girders during a process of manufacturing the final key segment; a second step of heating the reinforcing girders using a heating means according to conditions determined at the first step, thus thermally lengthening the reinforcing girders to predetermined lengths corresponding to the appropriate space length determined during the process of manufacturing the final key segment; a third step of closing a junction between the reinforcing girders at the center of the intermediate span of the bridge with the final key segment; and a fourth step of removing the heating means from the reinforcing girders after the junction between the reinforcing girders has been closed with the final key segment.

Furthermore, according to another aspect of the present invention, the above-mentioned steps may be sequentially executed after one end of the final key segment has been attached to one of the reinforcing girders.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Reference will now be made in greater detail to a preferred embodiment of the invention, an example of which is illustrated in the accompanying drawings.

Figure 1:
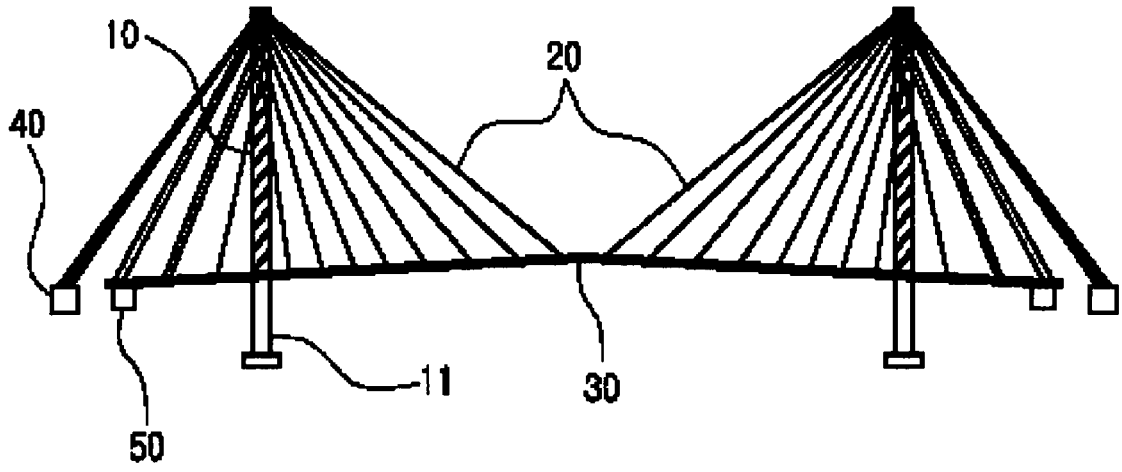
FIG. 1 is a view schematically illustrating the general idea of a partially earth-anchored cable-stayed bridge according to the present invention.

FIG. 1 is a view schematically illustrating the general idea of a partially earth-anchored cable-stayed bridge according to the present invention.

As illustrated in FIG. 1, the partially earth-anchored cable-stayed bridge according to the present invention comprises two cable support towers 10, reinforcing girders 30, cables 20, and outside anchor blocks 40. The outside anchor blocks 40 are installed outside the bridge and anchor some of the cables. By the outside anchor blocks 40 and the cables 20 anchored to the anchor blocks 40, the partially earth-anchored cable-stayed bridge is distinguished from other types of cable-stayed bridges. The partially earth-anchored cable-stayed bridge has a plurality of spans, which include an intermediate span between the two towers 10 and side spans outside the respective towers 10. In the drawing, the reference numeral 11 denotes a pier, and the numeral 50 denotes an abutment of the bridge.

In the related art, a conventional technique of building a partially earth-anchored cable-stayed bridge comprises the steps of: building two towers 10; building a span by sequentially coupling unit blocks of reinforcing girders 30 to each other in opposite directions from the two towers 10 using a cantilever construction technique while supporting the unit blocks of the girders 30 using cables 20 extending from the towers 10; coupling some cables 20 outside the unit blocks of the reinforcing girders 30 to the outside anchor blocks 40; and closing the junction between the reinforcing girders 30 at the center of an intermediate span with a final key segment 31, thus finishing the intermediate span.

The present invention provides a thermal prestressing technique, which is an optimum technique of applying an initial tensile force to the reinforcing girders at the step of closing the junction between the girders 30 with a final key segment 31. FIGS. 2A through 2E are views illustrating the process of closing the junction between the reinforcing girders 30 of a partially earth-anchored cable-stayed bridge at the center of the intermediate span with a final key segment 31, thus integrating the girders 30 into a single span according to an embodiment of the present invention.

Figure 2A:
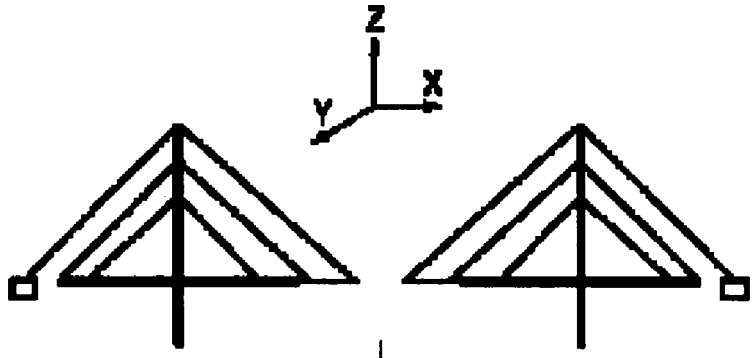
FIGS. 2A through 2E are views illustrating the process of closing a junction between reinforcing girders of the bridge at the center of an intermediate span of the bridge with a final key segment, thus integrating the girders into a single span according to an embodiment of the present invention.

FIG. 2A illustrates a state in which the reinforcing girders 30 of the intermediate span have been sequentially built from the two towers 10 to predetermined extents, but the junction between the girders 30 has not been closed with the final key segment 31. The method of constructing the partially earth-anchored cable-stayed bridge using the thermal prestressing technique according to the present invention will be adapted to the bridge in the state of FIG. 2A, as will be described in detail herein below.

First, at the step (first step) of FIG. 2A, which is the step just before the closure of the final key segment is executed, the interval between the two reinforcing girders is actually measured and, furthermore, the thermal expansive length of the reinforcing girders, which is required according to initial tensile force to be applied to the girders, is calculated. Thereafter, the desired length of the final key segment is determined and the final key segment having the desired length is manufactured. At the first step, in consideration of the atmospheric temperature expected at the time of closure of the final key segment, a target heating temperature of the reinforcing girders, which is equal to the temperature difference of the reinforcing girders before and after heating, is determined and, furthermore, a target heating region is determined. The heating temperature of the reinforcing girders is determined in consideration of both the expected atmospheric temperature at the time of closure of the final key segment and the temperature of the reinforcing girders after the girders have been completely heated. In the present invention, the heating temperature of the reinforcing girders preferably ranges from 40° C. to 70° C.

Figure 2B:
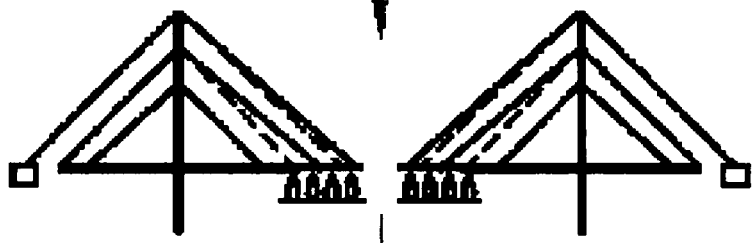

FIG. 2B illustrates a step (second step) of heating the reinforcing girders 30 using an artificial heating means according to both the heating region and the heating temperature determined at the first step, thus thermally lengthening the reinforcing girders 30 by the required thermal expansive length of the girders 30. In FIG. 2B, the dotted lines denote the position of the cables 20 before the reinforcing girders 30 are heated, while the solid lines denote the position of the cables 20 after the reinforcing girders 30 have been heated and have thermally expanded.

Figure 2C:
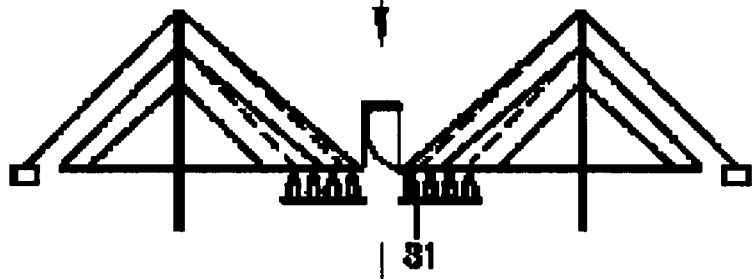
Figure 2D:
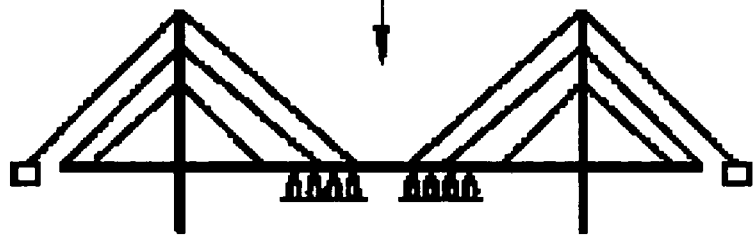

FIGS. 2C and 2D illustrates a step (third step) of pulling up the final key segment 31 using a machine, such as a crane, after the second step of heating and thermally expanding the reinforcing girders 30, and closing the junction between the reinforcing girders 30 at the center of the intermediate span with a final key segment 31. In the present invention, the closure of the final key segment 31 may be executed simultaneously at the two reinforcing girders 30 or, alternatively, may be executed with a time interval between the attachment of one end of the final key segment 31 to one reinforcing girder 30 and the secondary attachment of the other end of the final key segment 31 to the other reinforcing girder 30.

Figure 2E:
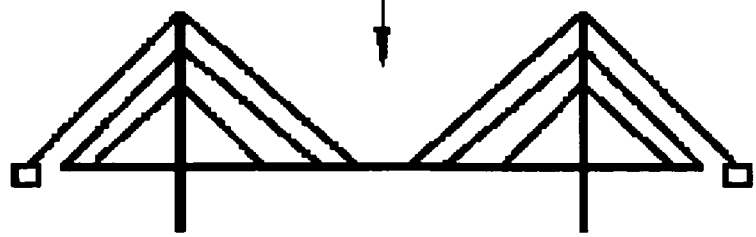

FIG. 2E illustrates a state in which the heating means has been removed from the reinforcing girders 30 after the closure of the final key segment 31 has been completely executed (fourth step). When the heating means has been removed from the reinforcing girders 30 after the closure of the final key segment 31 has been completely executed, the temperature of the heated reinforcing girders 30 is reduced to atmospheric temperature and thus the heated reinforcing girders 30 thermally shrink, thus applying initial tensile force to the reinforcing girders 30 and thermally prestressing the reinforcing girders 30.

Furthermore, after the step of removing the heating means from the girders 30, the crane and other construction machines are removed from the bridge prior to executing secondary work for installation of a bridge railing, pavement, and the like.

The preferred embodiment of the present invention, which has been described with reference to FIGS. 2A through 2E, is based on the thermal prestressing technique, in which the reinforcing girders 30 are heated to be thermally prestressed.

However, the present invention is not limited to the above-mentioned preferred embodiment, but may be variously embodied to apply an initial axial tensile force to the reinforcing girders 30 through a variety of construction methods to which the thermal prestressing technique can be adapted. One of the other construction methods will be described herein below as a second embodiment.

The method according to the second embodiment may further include a step of attaching a first end of the final key segment 31 to a first one of the reinforcing girders 30 before or after the first step of determining the heating region and the heating temperature of the reinforcing girders 30. This method also includes a step of attaching the second end of the final key segment 31 to a second one of the reinforcing girders 30 at the third step of closure of the final key segment 31.

Furthermore, if the closure of the final key segment 31 can be finished before the heated and thermally expanding reinforcing girders 30 have been cooled and thermally shrunk, the fourth step of removing the heating means from the reinforcing girders 30 may be executed after the second step of heating and thermally expanding the reinforcing girders 30.

The partially earth-anchored cable-stayed bridge related to the present invention has not been built or put to practical use anywhere in the world, so that the bridge construction method according to the present invention could not be adapted to an actual bridge. However, the bridge construction method according to the present invention was adapted to a model bridge as an experiment, in which the dimensions of the model bridge were set as follows.

In the experiment, the model bridge was configured as a steel box girder cable-stayed bridge, in which the intermediate span of the model bridge was 344 m and each of two side spans was 70 m, so that the total length of the bridge was 484 m. Furthermore, the length of the final key segment was 17 m and the thermal expansive length of each of the reinforcing girders, to which the target axial tensile force was to be applied, was 41.55 mm, so that the heating temperature of the reinforcing girders, having a total heating length of 68 m, was set to 50.9° C., in consideration of the unit length of 3.4 m of the steel box girders.

Figure 3:
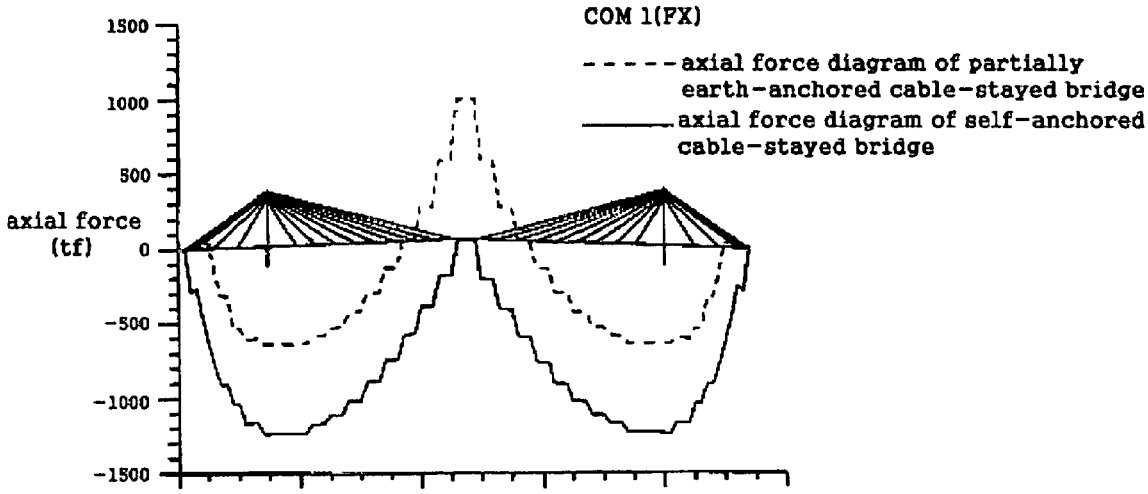
FIG. 3 is a diagram illustrating the distribution of axial force in the partially earth-anchored cable-stayed bridge built using the thermal prestressing technique according to the present invention, compared to a conventional self-anchored cable-stayed bridge.

FIG. 3 is a diagram illustrating the distribution of axial force in the partially earth-anchored cable-stayed bridge built using the thermal prestressing technique according to the present invention, compared to a conventional self-anchored cable-stayed bridge. As shown in FIG. 3, in the axial force diagram of the conventional self-anchored cable-stayed bridge, it is noted that compressive force is applied to the reinforcing girders. However, in the axial force diagram of the partially earth-anchored cable-stayed bridge built using the thermal prestressing technique according to the present invention, it is noted that both a tensile stressed region and a compressive stressed region are present in the reinforcing girders at the same time. In other words, nine hundred twenty nine tons (929 tons) of tensile force is applied to the intermediate span of the bridge of the present invention, while the compressive force around the towers is reduced by about 44.3%.

As described above, the partially earth-anchored cable-stayed bridge, which is built using a temperature prestressing technique, is advantageous in that tensile force is applied to the reinforcing girders, so that the reinforcing girders of the bridge are safer. Particularly, the compressive force around the towers of the bridge according to the present invention is remarkably reduced, so that the sectional area of the reinforcing girders can be reduced to desired levels. Furthermore, due to the improved safety and reduced axial force, the present invention can help realize a longer span of the partially earth-anchored cable-stayed bridge.

As is apparent from the above description, the method of constructing a partially earth-anchored cable-stayed bridge using a thermal prestressing technique according to the present invention provides advantages in that, while the junction between reinforcing girders is closed with a final key segment, a thermal prestressing technique is used to apply axial tensile force to the reinforcing girders, so that the partially earth-anchored cable-stayed bridge can be easily built.

Furthermore, the bridge construction method of the present invention reduces the compressive force that must be applied to the reinforcing girders because of the long span of a cable-stayed bridge, thus improving the safety of the reinforcing girders and, particularly and remarkably, reducing the compressive force around the towers, so that the sectional area of the reinforcing girders can be reduced to desired levels.

In addition, to close the junction between reinforcing girders of a partially earth-anchored cable-stayed bridge with the final key segment, the present invention does not require a conventional process of forcibly tensioning the reinforcing girders using hydraulic jacks.

Although a preferred embodiment of the present invention has been described so as to explain a method of constructing a partially earth-anchored cable-stayed bridge using a thermal prestressing technique, which is executed through a predetermined construction sequence, those skilled in the art will appreciate that various modifications, additions and substitutions are possible, without departing from the scope and spirit of the invention as disclosed in the accompanying claims.

What is claimed is:

1. A method of constructing a partially earth-anchored cable-stayed bridge using a thermal prestressing technique, in which, to apply a predetermined initial axial tensile force to reinforcing girders of the bridge, the initial axial tensile force is applied to the reinforcing girders while a center of an intermediate span of the bridge is closed with a final key segment, the method comprising:

a first step of determining an appropriate space length required for closure of the final key segment and of determining both a heating region and a heating temperature of the reinforcing girders according to the initial axial tensile force to be applied to the reinforcing girders during a process of manufacturing the final key segment;

a second step of heating the reinforcing girders using heating means according to conditions determined at the first step, thus thermally lengthening the reinforcing girders to predetermined lengths corresponding to the appropriate space length determined during the process of manufacturing the final key segment;

a third step of closing a junction between the reinforcing girders at the center of the intermediate span of the bridge with the final key segment; and a fourth step of removing the heating means from the reinforcing girders after the junction between the reinforcing girders has been closed with the final key segment.

2. A method of constructing a partially earth-anchored cable-stayed bridge using a thermal prestressing technique, in which, to apply a predetermined initial axial tensile force to reinforcing girders of the bridge, the initial axial tensile force is applied to the reinforcing girders while a center of an intermediate span of the bridge is closed with a final key segment, the method comprising:

a first step of attaching a first end of the final key segment to a first one of the reinforcing girders at the center of the intermediate span of the bridge;

a second step of determining an appropriate space length required for closure of the final key segment and of determining both a heating region and a heating temperature of the reinforcing girders according to the initial axial tensile force to be applied to the reinforcing girders during a process of manufacturing the final key segment;

a third step of heating the reinforcing girders using heating means according to conditions determined at the second step, thus thermally lengthening the reinforcing girders to predetermined lengths corresponding to the appropriate space length determined during the process of manufacturing the final key segment;

a fourth step of attaching a second end of the final key segment to a second one of the reinforcing girders at the center of the intermediate span of the bridge; and a fifth step of removing the heating means from the reinforcing girders after the junction between the reinforcing girders has been closed with the final key segment.

3. The method of constructing the partially earth-anchored cable-stayed bridge using the thermal prestressing technique according to claim 1, wherein the heating temperature of the reinforcing girders ranges from 40° C. to 70° C.

4. The method of constructing the partially earth-anchored cable-stayed bridge using the thermal prestressing technique according to claim 2, wherein the heating temperature of the reinforcing girders ranges from 40° C. to 70° C.

* * * * *